United States Patent [19]

Kondo et al.

[11] Patent Number: 5,061,101

[45] Date of Patent: Oct. 29, 1991

[54] AUTOMATIC SHEET FEED CONTROL SYSTEM FOR PRINTER

[75] Inventors: Yoshihisa Kondo, Morioka; Satoru Tsukihara, Iwate, both of Japan

[73] Assignee: Alps Electric Co., Ltd., Tokyo, Japan

[21] Appl. No.: 134,762

[22] Filed: Dec. 18, 1987

[30] Foreign Application Priority Data

Feb. 24, 1987 [JP] Japan ..... 62-41122

[51] Int. Cl.[5] ..... B41J 29/44

[52] U.S. Cl. ..... 400/706; 400/625

[58] Field of Search ..... 400/706, 708, 624, 625, 400/582, 708.1; 271/111

[56] References Cited

U.S. PATENT DOCUMENTS 4,089,402 5/1978 Hyland et al. ..... 400/625
4,644,372 2/1987 Hirota ..... 400/708 X
4,702,632 10/1987 Taketani ..... 400/708 X

*Primary Examiner*—David A. Wiecking
*Assistant Examiner*—Steven S. Kelley
*Attorney, Agent, or Firm*—Guy W. Shoup; Brian D. Ogonowsky; B. Noel Kivlin

[57] ABSTRACT

An automatic sheet feed control system for a printer having an automatic sheet feeder for sequentially feeding a plurality of sheets set on a tray of the feeder to a printing position to print and output the sheets which comprises the steps of discharging the sheet upon detecting of the end of the sheet when receiving a page feed command or a sheet discharge command from an external controller and during the sheet feeding or after feeding the sheet, storing the sheet discharged, and then feeding next sheet to print from a predetermined position when the sheet is discharged at printing time, thereby preventing in advance a sheet from being wound on a platen for a long period by eliminating to allow the sheet wound on the platen to stand for a long period.

2 Claims, 2 Drawing Sheets

AUTOMATIC SHEET FEED CONTROL SYSTEM FOR PRINTER

BACKGROUND OF THE INVENTION

1. FIELD OF THE INVENTION

This invention relates to an automatic sheet feed control system for a printer and, more particularly, to an improvement in an automatic sheet feed control system for a printer in which an automatic sheet feeder for sequentially automatically feeding a plurality of sheets cut in advance in one page size to a platen of the printer.

2. Description of the Prior Art

Heretofore, an automatic sheet feed control system for a printer described above has generally had independent commands for discharging and intaking sheets. In the control system of this type, when printing the next sheet, a command for discharging the printed sheet is first generated, and a command for intaking the next sheet is sequentially fed necessarily. As seen from a host computer side of an external controller, the control is very complicated, which increases its load.

Recently, an automatic sheet feed control system for executing the discharge of the printed sheet and the intake of the next sheet by one command was disclosed in Japanese Patent Laid-open No. 115470/1985. According to this control system, the control from the host computer is effectively simplified to alleviate its load, but after the sheet is discharged and next sheet is intaken, when a time until the next printing is started becomes long, the sheet is allowed to stand for a long period in the state rolled on a platen. Thus, the sheet is bent, which causes the sheet to be fed in a zigzag manner, thereby inducing trouble due to sheet jam.

SUMMARY OF THE INVENTION

Accordingly, an object of this invention is to provide an automatic sheet feed control system for a printer which can eliminate the above-mentioned drawbacks and which can prevent a sheet from being wound on a platen for a long period by eliminating standing of the sheet wound on the platen to stand for a long period.

In order to achieve the above and other objects of the invention, there is provided an automatic sheet feed control system for a printer having an automatic sheet feeder for sequentially feeding a plurality of sheets set on a tray of the feeder to a printing position to print and output the sheets comprising the steps of discharging the sheet upon detecting of the end of the sheet when receiving a page feed command or a sheet discharge command from an external controller and during the sheet feeding or after feeding the sheet, storing the sheet discharged, and then feeding the next sheet to print from a predetermined position when the sheet is discharged at printing time.

Since the automatic sheet feed control system for the printer is constructed as described above, when a page feed command or a sheet discharge command is received from a host computer of an external controller, or when the end of the sheet is detected, a flag for discharging the sheet or the sheet discharged is merely erected at this time, and the next sheet is intaken at later printing time. Therefore, the sheet is not allowed to stand in the rolled state on a platen for a long period to prevent in advance the sheet from jamming due to the bent of the sheet.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Embodiments of the present invention will be described in detail with reference to FIGS. 1 to 3.

Figure 1:
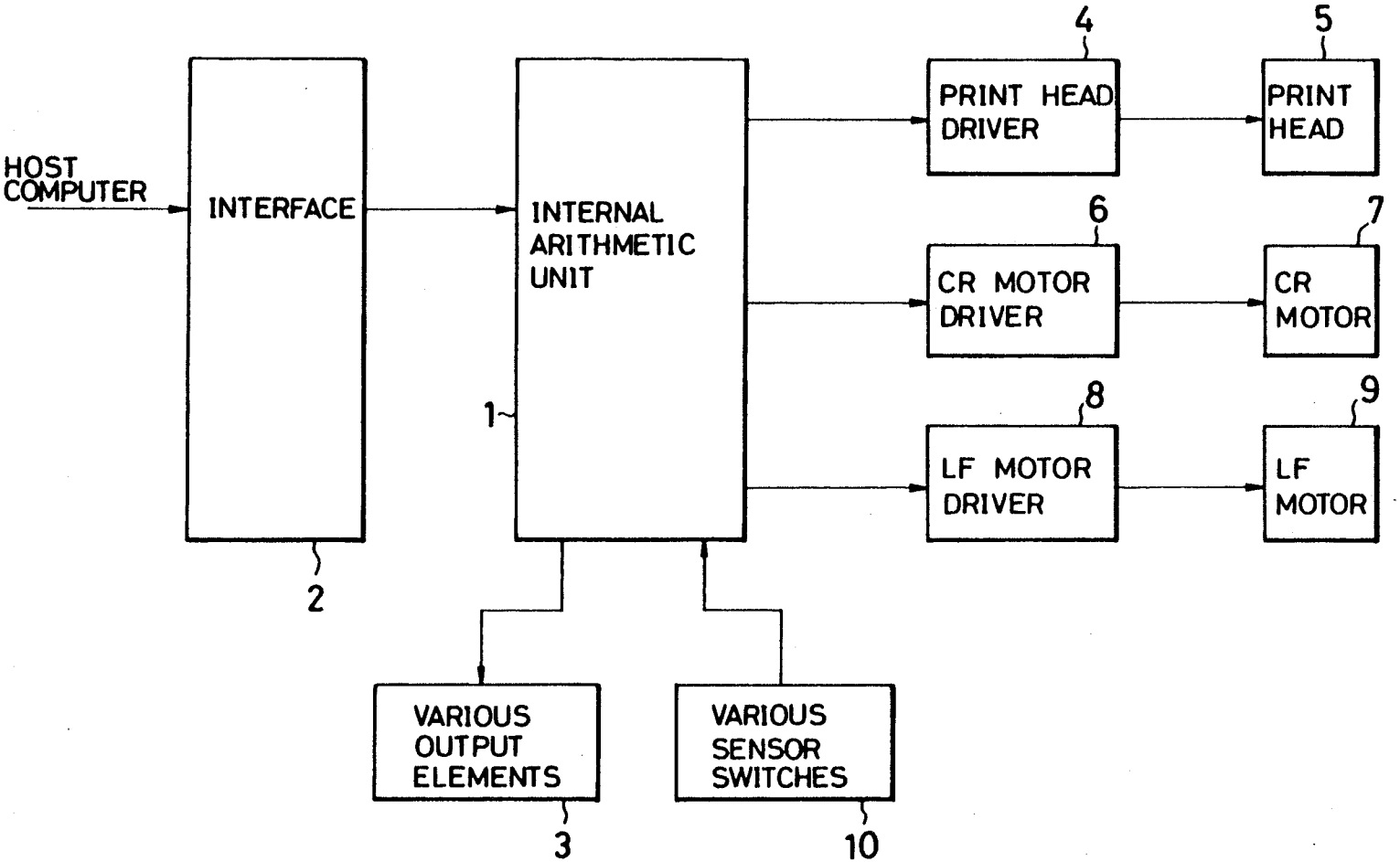
FIG. 1 is a block diagram of a hardware for executing an automatic sheet feed control system for a printer according to the present invention.

FIG. 1 is a block diagram showing a block configuration of a hardware for executing an embodiment of an automatic sheet feed control system for a printer according to the invention.

In FIG. 1, reference numeral 1 designates an internal arithmetic unit (CPU). The CPU 1 receives a command through an interface 2 from a host computer, not shown, as an external controller, controls a print head 5 through various output elements 3 and a print head driver 4, a CR motor 7 through a CR (reset) motor driver 6 and an LF motor through an LF (line feed) motor driver 8, and receives data from various sensors and switch group 10 for a power source and the like.

Figure 2:
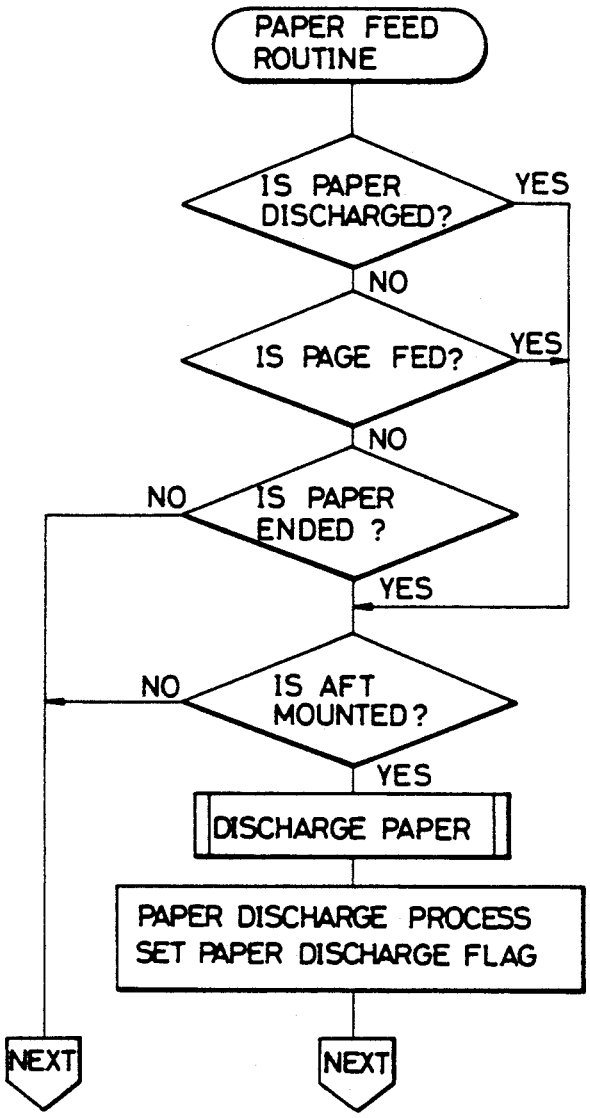
FIG. 2 is a flowchart showing the sheet discharging process.
Figure 3:
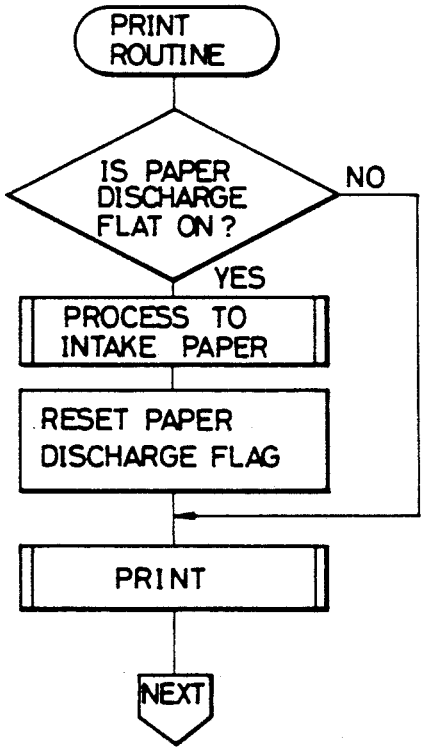
FIG. 3 is a flowchart showing the sheet intaking process.

FIG. 2 shows a flowchart for indicating the process of discharging paper or a sheet. The process for discharging the sheet first checks, is paper discharged? If YES is judged, the process is shifted to check, is an automatic sheet feeder (ASF) mounted If NO is judged, the process checks, is page fed? If YES is judged, the process is shifted to check, is the automatic sheet feeder mounted?, but if NO is judged, the process checks, is the end of the paper detected? If NO is judged, the process is shifted to the next process, but If YES is judged, the process checks, is the automatic sheet feeder mounted? In this check, if NO is judged, the process is shifted to the next process, but if YES is judged, the process for discharging the sheet is executed, a flag for the sheet discharged is set, and the process is then shifted to the next process. Further, FIG. 3 is a flowchart for indicating the process for intaking paper or a sheet prior to the printing. The process first checks, is flag for the sheet discharged set? If NO is judged, the sheet is set on the platen, the printing process is executed as it is. If YES is judged, the process for intaking the sheet, i.e., a sheet to be newly printed is set on the platen, the flag for the sheet discharged is reset, and the printing process is then executed.

According to the automatic sheet feed control system of the present invention as described above, when the automatic sheet feeder is used, the flag for the sheet discharged may be merely set when the sheet is discharged, and the sheet is then controlled to be newly intaken when the printing is executed so that the sheet does not stand rolled on the platen for a long period, thereby preventing in advance a trouble of feeding the sheet due to the bent of the sheet.

What is claimed is:

1. An automatic sheet feed control system for a printer having a feeding means for sequentially feeding sheets stacked on a tray to a printing position, and discharge means for discharging a printed sheet after printing, comprising:

first means for detecting the end of a printed sheet after printing;

means for setting a paper discharge flag after discharge of a sheet by said discharge means; and means for detecting whether said paper discharge flag is set at a printing time;

wherein said discharge means discharges the sheet after the end of a printed sheet has been detected by said first detecting means at a time previous to said printing time, and said feeding means feeds a next sheet if the set condition of said paper discharge flag is detected at said printing time.

2. A method for automatically feeding and discharging sheets to and from a printer, comprising the steps of:

discharging a sheet after printing upon detection of the end of said sheet;

setting a paper discharge flag after discharge of said sheet;

detecting whether the discharge flag is set at a printing time subsequent to the time said sheet was discharged;

feeding a next sheet if the discharge flag is set; and printing said next sheet.

* * * * *